United States Patent [19]

Seghetti

[11] Patent Number: 4,820,889

[45] Date of Patent: Apr. 11, 1989

[54] TRIGGER SWITCH ASSEMBLY

[75] Inventor: Leland L. Seghetti, St. Louis, Mo.

[73] Assignee: Essex Industries, Inc., St. Louis, Mo.

[21] Appl. No.: 143,679

[22] Filed: Jan. 14, 1988

[51] Int. Cl.[4] ..... H01H 9/06

[52] U.S. Cl. ..... 200/61.85; 200/1 B; 200/522

[58] Field of Search ..... 200/61.85, 1 B, 157, 200/153 T, 318, 319, 320, 321, 322, 323, 324, 325, 326, 327, 329, 340

[56] References Cited

U.S. PATENT DOCUMENTS 3,142,227 7/1964 Stringer ..... 200/157 X 3,511,951 5/1970 Miller ..... 200/157

*Primary Examiner*—A. D. Pellinen

*Assistant Examiner*—Morris Ginsburg

*Attorney, Agent, or Firm*—Kalish & Gilster

[57] ABSTRACT

Apparatus in a trigger grip switch assembly for sequential actuation of first and second electrical switch banks. First and second actuating elements each have a base portion, a switch-actuating arm extending from the base portion, and a resilient pressure-transferring arm extending from the base portion at an acute angle to the respective switch-actuating arm. The respective base portions are mounted for pivotal movement relative to the respective first and second switches and for presenting the switch-actuating elements in respective proximity to the first and second switches for actuation thereof upon base portion pivoting movement and for presenting the pressure-transferring arms in mutually overlapping relation with a distal end portion of a first pressure-transferring arm in contact with a medial portion of a second pressure-transferring arm. The pressure-transferring arms form between them an angle at least slightly greater than 30 degrees to provide an over-centered stable relationship. Pressure transferred by a trigger switch button to a distal end portion of the second pressure-transferring arm causes destabilizing sequential collapsing movement from the overcentered relationship for corresponding sequential actuation of the switches.

11 Claims, 1 Drawing Sheet

FIG. 1
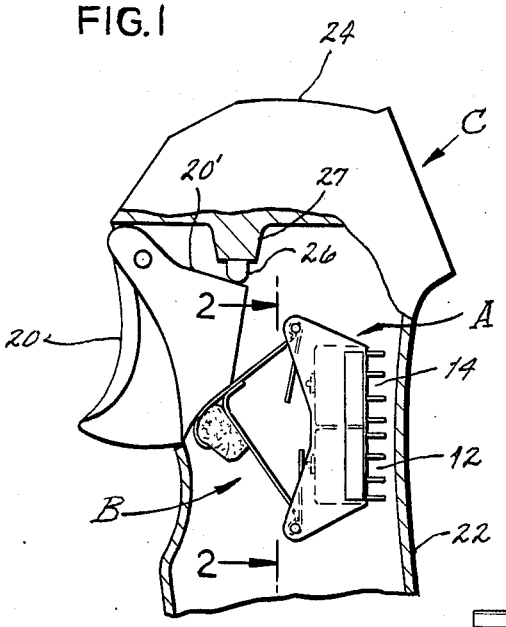
FIG. 2
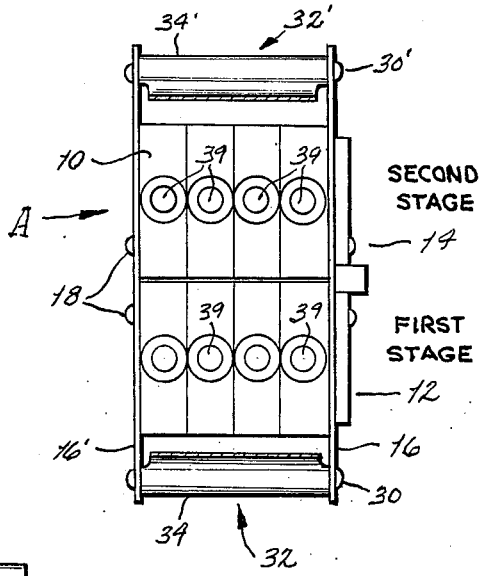
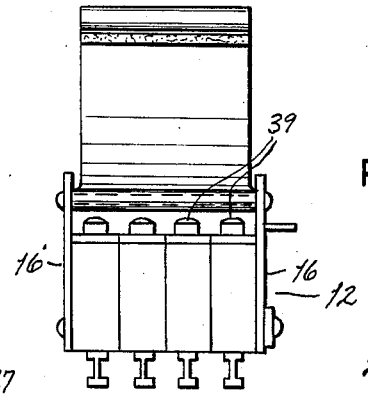
FIG. 3
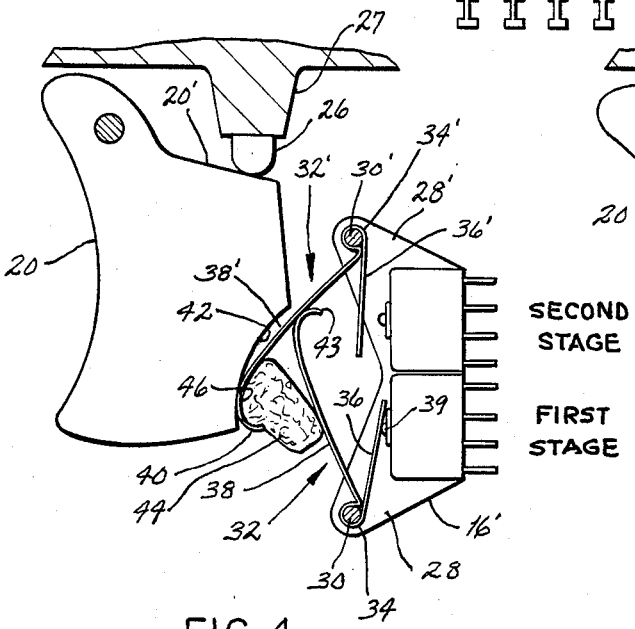
FIG. 4
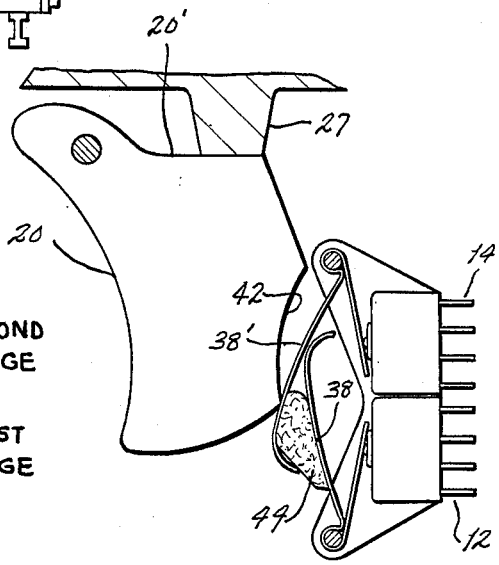
FIG. 5

TRIGGER SWITCH ASSEMBLY

BACKGROUND AND SUMMARY OF THE INVENTION

This invention relates to electrical switches and, more particularly, to apparatus for actuation of electrical switches and like devices.

Extremely high reliability and high meantime between failures (MTBF) are important design goals for electrical switches used in certain industrial and military applications where safety and predictability of operation are of paramount importance, as for example, for electrical switches incorporated in aircraft control stick grips. These grip switches are often used to control critical operational functions such as the selective delivery of ordnance. In such applications, the switches and switch actuating mechanism are exposed to wide variations of operating conditions and environments, yet must provide precise, reliable operation with high MTBF over long periods of time such as many years.

Accordingly, among the several objects of the invention, may be noted the provision of improved apparatus for electrical switch actuation, which provides extreme reliability with high MTBF; which provides predictably precise operation as well as operational characteristics especially well suited for operating electrical switches incorporated in aircraft control stick grips; which brings about proper operation even when exposed to wide variations of operating conditions in environments over long periods of time; but which is extraordinarily and, indeed, unexpectedly of simple configuration and marked economy.

Other objects and features of the invention will be apparent or are pointed out hereinbelow.

BRIEF DESCRIPTION OF THE DRAWINGS

FIG. 1 is a cross-sectional elevation of vertical character through an aircraft control stick grip, as broken away, illustrating in side elevation an electrical switch assembly and electrical switch actuation apparatus in accordance with and embodying the present invention.

FIG. 2 is a front elevation view of the switch assembly and portions of the actuation apparatus, as taken generally along line 2—2 of FIG. 1.

FIG. 3 is a bottom plan view of the switch assembly and actuating apparatus.

FIG. 4 is an enlarged side elevation view of the switch assembly and actuating apparatus, illustrating a first relationship of elements upon actuation.

FIG. 5 is a similar illustration of the switch assembly and actuating apparatus, illustrating further movement of the elements during actuation.

Corresponding reference characters indicate corresponding elements throughout the several views of the drawings.

DESCRIPTION OF THE PREFERRED EMBODIMENT

Referring now to the drawings, and particularly to FIGS. 1-3, designated at A is an electrical switch assembly comprising a plurality of switches 10 joined together in a first stage lower row 12 and a second stage upper row 14 and so maintained in this configuration by a bracket arrangement including side plates 16, 16' joined together and maintained in spaced relationship by appropriate rivets, as at 18 which extend through the assembly.

Said bank of switches A is actuated by an actuator apparatus B of the present invention in response to a trigger switch button 20 which forms part of a control grip assembly which is designated in its entirety generally at C.

The control grip assembly or apparatus C includes a hand grip 22 including an upper portion 24, which may contain various switches used for control of an aircraft or its weapon systems, etc., and intended to be gripped by the hand of the pilot with the index finger being positioned for actuating grip switch 20.

In accordance with the invention, switch assembly A is actuated through operation of actuating apparatus B upon grip switch being depressed, as resisted by an internal spring or other resistance mechanism 26 of assembly C, such as will provide a predetermined force for resisting squeezing of trigger grip actuator 20. Mechanism 26 extends from a projection or housing 27 for engaging a shoulder 20' of the activator.

Referring now also to FIG. 4, each of the bracket plates 16, 16' is provided with a generally triangular upper, outer extension, as shown at 28, 28', the same serving as lower and upper means, respectively, for attachment of certain switch-actuating arms of the invention. Extending across the lower and upper extensions at distal portions thereof are respective hinge pins 30, 30' which extend through apertures provided in such extensions 28, 28', and suitably upset or crimped to be retained in place.

Pivoted on these arms are lower and upper switch actuating elements, as designated generally at 32, 32'. Each such element has a corresponding base portion, as respectively designated at 34, 34', which is formed by bending so as to encompass and surround the respective pivot shaft 30, 30' for permitting pivotal movement of such switch actuating elements. Extending outwardly from the respective base portions are switch-actuating arms, 36, 36' which overlap the respective lower and upper rows of switches 12, 14, being thereby presented for contacting switch actuating buttons 39 which extend upwardly from each such switch.

The switches, it will be noted, are ganged so that switches of each such row will all be adapted to be actuated simultaneously by such switch actuating arms in response to the squeezing of grip switch actuator 20. However, a sequential mode of operation of the switches 12, 14 is provided by the present switch actuating apparatus. Such sequential operation is desired for carrying out the switching function to be provided in response to squeezing of grip switch actuator 20 in order to bring about a first group of electrical closures (i.e., those of the lower row 12) in response to a first degree of actuator 20 being depressed, and then to provide a further group of switch closures (i.e., those of the upper row 14) upon the actuator 20 being further depressed.

Referring to FIG. 1, there is illustrated the normal position of the switch actuating elements, 32, 32' under the condition in which grip switch actuator 20 has not been squeezed or depressed. Each such switch actuator element has a pressure-transferring arm, as respectively designated at 38, 38' which extends from its respective base portion at an acute angle to the respective switch-actuating arm. The pressure-transferring arms are presented in mutually overlapping relationship with a distal portion of a first one of the pressure-transferring arms, namely arm 38, being in contact with a medial portion of the second arm 38', such that these pressure-transferring arms provide or form between them an angle of at least slightly greater than 90° to provide an over-centered relationship.

According to the preferred construction, the switch actuating elements are each formed of an integral length of stainless steel of high tensile strength and relatively substantial resilience and so to provide a springy characteristic. Because of the resilience of the pressure-transferring arm, pressure received at the distal end of pressure-transferring arm 38' will cause sequential collapsing movement from the over-centered relationship of the arms for corresponding sequential operation of the first and second rows (i.e. stages) of switches 12, 14, respectively.

Such sequential operation is illustrated in FIGS. 4 and 5. In FIG. 4, the curved distal end, as at 40, of arm 38' is contacted by corresponding curvilinearly notched portion 42 of the grip switch actuator 20. Such notched portion is of curved configuration so as to conform approximately to the natural curvature of the switch actuating arm 38' and its C-shaped distal end 40. Thus it is seen that both arms 38, 38' provide an outwardly convex configuration relative to the switch stages 12, 14. Accordingly, when the grip switch actuator 20 is depressed to the position shown in FIG. 4, the bending of switch actuating arm 38', i.e., with partial buckling causing increased curvature of arm 38', produces destabilization of the over-centered relationship of arm 38 relative to arm 38' and so causes the curved C-shaped distal end 43 of switch actuating arm 38 to collapse with a detent force and to provide pivoting accordingly about the lower pivot pin 30. This movement brings the switch-actuating arm 36 into contact with the actuating buttons 39 of the lower row of switches 12 (stage 1). Continuation of movement of actuator 20 as shown in FIG. 5, until shoulder 20' engages projection 27 then actuates in sequence the upper row of switches 14 (stage 2). Releasing the force on actuator 20 reverses the switch sequence of operation as follows: The upper set of switches 14 open first; then, with a continuation of actuator 20 movement to the rest position, the lower set of switches 12 open. A pad 44 of resilient poromeric material of elongated shape having edge-rounded character is affixed to the inner surface of arm 38' within the curved inside region of its distal end 40, as by securement of a thin adhesive layer 46. Pad. 44 determines i.e., locates, the rest position of arm 38, as shown in FIG. 1 and also damps return movement of arm 38 after actuation. It also serves to transfer actuating force from arm 38' to arm 38 for actuating the second stage switches. In so doing, pad 44 compresses resiliently as shown in FIG. 5.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. Apparatus in combination with at least first and second electrical switches for sequential actuation thereof, comprising first and second actuating elements each having a base portion and a resilient pressure-transferring arm extending from the base portion, means for pivotally mounting the respective first and second switches for actuation of the first and second switches upon pivoting movement of the respective first and second switch-actuating elements, and for presenting the pressure-transferring arms in mutually overlapping relation with a distal portion of a first one of the pressure-transferring arms in contact with a portion of a second one of the pressure-transferring arms such that the first and second pressure-transferring arms form between them an angle sufficient or providing an over-centered stable relationship, and means for connecting each base portion to respective ones of the switches whereby pressure received by a distal end of the second pressure-transferring arm will cause sequential collapsing movement from the over-centered relationship of the pressure-transferring arms for corresponding sequential actuation of the first and second switches.

2. Apparatus according to claim 1 wherein the means for connecting each base portion to respective ones of the switches comprise a switch-actuating arm extending from a respective base portion for switch-actuating movement upon said collapsing movement.

3. Apparatus according to claim 2 wherein each switch-actuating arm forms with the respective pressure-transferring arm an acute angle.

4. Apparatus according to claim 1 wherein a distal end portion of each pressure-transferring arm is curved.

5. Apparatus according to claim 4 wherein the distal end portion of each pressure-transferring arm.is C-shaped to define an outwardly convex configuration relative to the switches.

6. Apparatus according to claim 5 wherein the second arm undergoes partial buckling in response to pressure for causing increased pressure to produce destabilization of the over-centered relationship.

7. Apparatus according to claim 4 wherein the distal portion of at least one of the pressure-transferring arms carries a pad of resilient poromeric material for determining a rest position of the distal end portion of the first pressure-transferring arm relative to the second pressure-transferring arm.

8. Apparatus according to claim 7 wherein the pad serves to transfer actuating force from the second pressure-transferring arm to the first pressure-transferring arm.

9. Apparatus according to claim 4 further comprising a trigger switch button including a curvilinearly notched portion for engaging the distal end portion of the second pressure-transferring arm.

10. Apparatus in combination with at least first and second electrical switches for sequential actuation of said electrical switches, comprising first and second actuating elements each having a base portion, a switch-actuating arm extending from the base portion at an acute angle to the respective switch-actuating arm, and a pressure-transferring arm extending from the base portion at an acute angle to the respective switch-actuating arm, means for pivotally mounting the respective base portions for pivotal movement relative to the respective first and second switches and for presenting the switch-actuating elements in respective proximity to the first and second switches for actuation thereof upon pivoting movement of the respective first and second switch-actuating elements, and for presenting the pressure-transferring arms in mutually overlapping relation with a distal end portion of a first one of the pressure-transferring arms in contact with a medial portion of a second one of the pressure-transferring arms such that the first and second pressure transferring arms form between them an angle at least slightly greater than 30 degrees to provide an over-centered stable relationship, the first and second pressure-transferring arms being resilient, whereby pressure received by a distal end portion of the second pressure-transferring arm will cause destabilization of the over-centered relationship of the pressure-transferring arms for corresponding sequential actuation of the first and second switches.

11. In a trigger grip switch assembly including a moveable trigger switch button including an actuating portion, apparatus for sequential actuation of at least first and second electrical switches of said assembly, comprising first and second actuating elements each having a base portion, a switch-actuating arm extending from the base portion, and a pressure-transferring arm extending from the base portion at an acute angle to the respective switch-actuating arm, means for pivotally mounting the respective base portions for pivotal movement relative to the respective first and second switches and for presenting the switch-actuating elements in respective proximity to the first and second switches for actuation thereof upon pivoting movement of the respective first and second switch-actuating elements, and for presenting the pressure-transferring arms in mutually overlapping relation with a distal end portion of a first one of the pressure-transferring arms in contact with a medial portion of a second one of the pressure-transferring arms such that the first and second pressure-transferring arms form between them an angle at least slightly greater than 30 degrees to provide an over-centered stable relationship, the first and second pressure-transferring arms being resilient, the distal end portion of the second pressure-transferring arm being positioned for receiving actuating pressure from the actuating portion of the switch button whereby such pressure will cause destabilization of the over-centered relationship for causing sequential collapsing movement from the over-centered relationship of the pressure-transferring arms for corresponding sequential actuation of the first and second switches.

* * * * *

UNITED STATES PATENT AND TRADEMARK OFFICE

CERTIFICATE OF CORRECTION

PATENT NO. : 4,820,889

DATED : April 11, 1989

INVENTOR(S) : Leland L. Seghetti

It is certified that error appears in the above-identified patent and that said Letters Patent is hereby corrected as shown below:

Col. 4, line 6 After "the", insert:

--respective base portions for pivotal movement relative to the--

Signed and Sealed this

Third Day of April, 1990

*Attest:*

HARRY F. MANBECK, JR.

*Attesting Officer*

*Commissioner of Patents and Trademarks*